United States Patent [19]

Gernert

[11] 4,314,024

[45] Feb. 2, 1982

[54] STABILIZED PHOTOGRAPHIC EMULSION, A PROCESS FOR ITS PREPARATION AND STABILIZED PHOTOGRAPHIC MATERIALS

[75] Inventor: Herbert Gernert, Munich, Fed. Rep. of Germany

[73] Assignee: Agfa-Gevaert Aktiengesellschaft, Leverkusen, Fed. Rep. of Germany

[21] Appl. No.: 173,709

[22] Filed: Jul. 30, 1980

[30] Foreign Application Priority Data

Aug. 4, 1979 [DE] Fed. Rep. of Germany ..... 2931690

[51] Int. Cl.[3] ..... G03C 1/34

[52] U.S. Cl. ..... 430/564; 430/603; 430/611

[58] Field of Search ..... 430/611, 603, 564

[56] References Cited

U.S. PATENT DOCUMENTS

| | | | |
|---|---|---|---|
| 2,438,716 | 3/1948 | Mueller | 430/611 X |
| 3,043,696 | 7/1962 | Herz et al. | 430/611 X |
| 3,708,302 | 1/1973 | Plakonov et al. | 430/600 |

FOREIGN PATENT DOCUMENTS

| | | | |
|---|---|---|---|
| 2335093 | 1/1974 | Fed. Rep. of Germany . | |
| 1386630 | 3/1975 | United Kingdom | 430/611 |

*Primary Examiner*—Mary F. Downey
*Attorney, Agent, or Firm*—Connolly and Hutz

[57] ABSTRACT

Photographic silver halide emulsions are stabilized by aminocarboxylic acids.

8 Claims, No Drawings

STABILIZED PHOTOGRAPHIC EMULSION, A PROCESS FOR ITS PREPARATION AND STABILIZED PHOTOGRAPHIC MATERIALS

This invention relates to a photographic emulsion which has been stabilized and improved in its sensitivity by the addition of certain aminocarboxylic acids. It also relates to a process for the preparation of photographic emulsions and to photographic materials.

It is known that materials containing light-sensitive silver halide emulsions tend to form fog due to nuclei which are capable of development without exposure. Such fogging is particularly likely to occur when the emulsions have been stored too long, especially at elevated temperatures and atmospheric moisture.

It is known to add so-called antifogging agents or stabilizers to photographic silver halide emulsions to improve their stability. By the "stability" of a photographic material is meant, inter alia, a very low increase in fog during storage and only slight deviations in the density of the stored material compared with its fresh state. It is particularly in silver iodobromide emulsions that storage under elevated temperature conditions is frequently found to be accompanied by an increase in sensitivity with a concomitant increase in the fog values. This characteristic is also observed under normal storage conditions and causes a continuous change in the density during storage, which is particularly troublesome in materials used for reprographic purposes, where high standards of stability of the material are required. Compounds which have a stabilizing effect include, for example, the heterocyclic mercapto compounds, such as those described in German Auslegeschrift No. 1,183,371 and German Offenlegungsschriften Nos. 2,308,530 and 1,622,271.

These stabilizers have, however, the disadvantage that if used at effective concentrations they generally lower the sensitivity of the stabilized emulsion and thereby impair its usefulness. The gradation of the emulsion may also be deleteriously affected by these stabilizers.

Stabilizers are required to meet a wide variety of demands which are generally not satisfied by the known stabilizers, particularly with regard to their interaction with other photographic additives and their adaptability to the wide variety of photographic reproduction processes and the photographic materials used for them.

It is also known to sensitize photographic silver halide emulsions chemically with sodium thiosulphate, polythionates, thiosamine or other sulphur compounds as well as gold and palladium compounds. Reducing substances may also be used to increase the sensitivity. This increased sensitivity is generally accompanied by increased fogging and reduction in the stability.

When sensitivity increasing substances are used, it is normally found when testing the stability of the photographic material at elevated temperature, that in the most favourable case the increase in sensitivity is accompanied by a corresponding slight increase in the fog value.

It was one of the objects of the present invention to find substances which would improve the stability in the sence described above while leaving the sensitivity unchanged or even increasing it.

This invention therefore provides a photographic silver halide emulsion which contains at least one compound corresponding to formula I

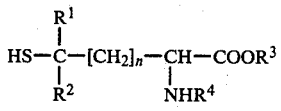

(I)

in which $R^1$ represents hydrogen or an alkyl, aryl, aralkyl or acyl group;

$R^2$ represents an alkyl, aryl, aralkyl or acyl group;

$R^3$ represents hydrogen or a cation;

$R^4$ represents hydrogen or an alkyl or acyl group and n represents 0 or a whole number, and/or $R^1$ together with $R^2$ represents the atoms required to complete a preferably carbocyclic ring, in particular a cyclopentyl or cyclohexyl ring.

Compound I may be present in the emulsion in the form of a disulphide; it may also be present as a salt, in which both the carboxyl group and the amino group may take part in salt formation.

The present invention also relates to a process for the preparation of photographic emulsions by precipitation in the presence of a protective colloid and addition to the emulsion of the compound to be used according to the invention. It also relates to a photographic material comprising a support, at least one silver halide emulsion layer and optionally other layers, at least one layer containing a compound used according to the invention. The compound used according to the invention is preferably contained in a silver halide emulsion layer but it may also be contained in another colloid layer which is free form silver halide but is in water-permeably relationship to at least one silver halide emulsion layer.

The compounds used according to the invention are generally added to the emulsion in quantities of not more than 9 mg per mol of silver halide. The emulsions therefore generally do not contain more than 9 mg of the compound used according to the invention per mol of silver halide.

A preferred range of quantities is from 0.1 to 8 mg per mol of silver halide, in particular from 0.2 to 4 mg per mol of silver halide.

The above mentioned alkyl, aryl and acyl group may also be substituted with substituents which have no deleterious effect in photographic materials.

Preferred alkyl groups ($R^1$, $R^4$ and $R^2$) have 1 to 4 carbon atoms, for example, methyl or butyl. Methyl and ethyl are particularly preferred.

Preferred aryl groups ($R^1$ and $R^2$) may have 6 to 12 carbon atoms, in particular phenyl.

Preferred aralkyl groups ($R^1$ and $R^2$) have 1 or 2 carbon atoms in the aliphatic moiety and 6 to 12 carbon atoms in the aromatic moiety, for example benzyl.

The acyl groups ($R^1$, $R^2$ and $R^4$) include in particular those derived from aliphatic or aromatic carboxylic or sulphonic acids, including carbonic acid monoesters, carbamic acids and sulphamic acids. Examples of such acyl groups include formyl, benzoyl, phenylcarbamoyl and ethoxycarbonyl. Acetyl is particularly preferred.

$R^3$ is preferably hydrogen, ammonium or an alkali metal cation, in particular sodium or potassium;

n is preferably 0, 1 or 2, in particular 0.

Compounds in which $n=0$ and $R^4$ represents hydrogen are particularly preferred.

Examples of compounds which may be used according to the invention are shown in Table 1 below. Methods of preparing them are known from the literature.

TABLE 1

| Compound No. | $R^1$ | $R^2$ | $R^3$ | $R^4$ | n |
|---|---|---|---|---|---|
| 1.1 | $CH_3$— | $CH_3$— | —H | —H | 0 |
| 1.2 | $CH_3$— | —H | —H | —H | 1 |
| 1.3 | $C_2H_5$— | —H | —H | —H | 0 |
| 1.4 | $C_2H_5$— | $C_2H_5$— | —H | —H | 0 |
| 1.5 | $CH_3$— | $CH_3$— | —H | —H | 1 |
| 1.6 | —$[CH_2]_4$— | | —H | —H | 1 |
| 1.7 | $CH_3$— | $CH_3$— | —H | $CH_3$— | 0 |
| 1.8 | —$[CH_2]_5$— | | —H | —H | 1 |
| 1.9 | $CH_3$— | $CH_3$— | —H | —$COCH_3$ | 0 |

Among the compounds to be used according to the invention, compound 1.1 (penicillamine) is particularly preferred. This compound has been described in German Offenlegungsschrift No. 2,335,093 as a substance added to photographic silver halide emulsions in a quantity of 10–5000 mg per mol of silver halide to stabilize the latent image. It is therefore surprising that when this compound is added to the emulsion in quantities at the most 9 mg per mol of silver halide it not only reduces fogging and stabilises the density but at the same time substantially increases the sensitivity.

The compounds used according to the invention may be introduced into at least one layer or intermediate layer of a photographic material. For example, they may be added to the light-sensitive silver halide emulsions or to the finished casting solution or they may be applied to the photographic material together with the last protective layer.

Addition of the compounds used according to the invention to the light-sensitive silver halide emulsions may, in principle, be carried out at any stage during the preparation or processing of the emulsion. According to a preferred embodiment, the stabilizers used according to the invention are added after chemical ripening, preferably to the finished casting solution.

The compounds used according to the invention may be introduced into the usual light-sensitive photographic materials suitable for the preparation of black-and-white images, e.g. black-and-white recording or copying materials or reversal materials. The materials may also contain colour couplers without the stabilizing effect being thereby deleteriously affected.

The usual silver halide emulsions consisting either of pure silver halides or of mixtures thereof are suitable for the present invention. The silver halide grains may consist, for example, of silver chloride, silver bromide, silver iodide, silver chlorobromide, silver iodochloride, silver iodobromide or silver iodobromochloride. The present invention is suitable in particular for silver iodobromide emulsions having an iodide content of up to 8 mol %.

The emulsions may be chemically sensitized, e.g. by the addition of sulphur compounds such as allyl isothiocyanate, allyl thiourea, sodium thiosulphate or the like at the chemical ripening stage. Reducing agents may also be used as chemical sensitizers, e.g. the tin compounds described in Belgian Pat. Nos. 493,464 and 568,687, or polyamines such as diethylenetriamine or aminoethylsulphinic acid derivatives, e.g. according to Belgian Pat. No. 547,323.

The emulsions may also be sensitized with polyalkylene oxide derivatives, e.g. with a polyethylene oxide having a molecular weight in the range of 1000 to 20,000, or with condensation products of alkylene oxides and aliphatic alcohols, glycols or cyclic dehydration products of hexitols, or with alkyl substituted phenols, aliphatic carboxylic acids, aliphatic amines or aliphatic diamines and amides. The condensation products have a molecular weight of at least 700, preferably more than 1000. These sensitizers may, of course, also be combined to produce special effects, as described in Belgian Pat. No. 537,278 and British Pat. No. 727,982.

The emulsions are preferably not optically sensitized or orthosensitized with the usual dyes.

The emulsions may be hardened in the usual manner, for example with formaldehyde or halogen-substituted aldehydes containing a carboxyl group, such as mucobromic acid, diketones, methanesulphonic acid esters or dialdehydes. The photographic layers may also be hardened with epoxide, heterocyclic ethylene imine or acryloyl hardeners. Examples of such hardeners have been described, for example, in German Offenlegungsschrift No. 2,263,602 and British Pat. No. 1,266,655.

The layers may also be hardened by the process according to German Offenlegungsschrift No. 2,218,009 to produce photographic materials suitable for high temperature processing.

Furthermore, the photographic layers or colour photographic multilayer materials may be hardened with diazine, triazine or 1,2-dihydroquinoline hardeners as described in British Pat. Nos. 1,193,290; 1,251,091; 1,306,544 and 1,266,655, French Pat. No. 71-02716 or German Offenlegungsschrift No. 2,332,317. Examples of such hardeners include diazine derivatives containing alkylsulphonyl or arylsulphonyl groups, derivatives of hydrogenated diazines or triazines such as 1,3,5-hexahydrotriazine, fluorosubstituted diazine derivatives such as fluoropyrimidine and esters of 2-substituted 1,2-dihydroquinoline- or 1,2-dihydroisoquinoline-N-carboxylic acids. Vinylsulphonic acid hardeners and carbodiimide or carbamoyl hardeners may also be used, e.g. those described in German Offenlegungsschriften Nos. 2,263,602; 2,225,230 and 1,808,685; French Pat. No. 1,491,807; German Pat. No. 872,153 and DDR Pat. No. 7218. Other suitable hardeners have been described, for example, in British Pat. No. 1,268,550.

The present invention is applicable both to the production of black-and-white images and to the production of colour photographic images. Colour photographic images may be produced, for example, by the known method of chromogenic development in the presence of colour couplers which react with the oxidation product of colour producing p-phenylenediamine developers to form dyes. The colour couplers may be incorporated in at least one layer of the photographic material, e.g. at least one silver halide layer. Examples of suitable colour couplers may be found in the publication, "Farbkuppler" by W. Pelz in "Mitteilungen aus den Forschungslaboratorien der Agfa, Leverkusen/-Munchen", Vol. III (1961) and K. Venkataraman in "The Chemistry of Synthetic Dyes", Vol. 4, pp 341–387, Academic Press (1971).

The emulsions may be applied to the usual substrates e.g. to substrates made of cellulose esters such as cellulose acetate or cellulose acetobutyrate, or polyesters, in particular polyethylene terephthalate or polycarbonates, especially those based on bis-phenylolpropane. Paper substrates are also suitable, and these may contain water impermeable polyolefine layers, e.g. of polyethylene or polypropylene; glass or metal substrates may also be used.

The usual black-and-white developer compounds such as hydroxybenzenes and 3-pyrazolidones are suitable for black-and-white development. The usual colour developer substances may be used for producing colour images.

EXAMPLE 1

1.2 g of triazaindolizine per mol of silver halide are added after completed after-ripening to a silver iodobromide emulsion which has been sensitized with gold and thiosulphate and has an iodide content of 2.5 mol % and medium sensitivity. To this emulsion which has been adjusted to a silver content of 170 g of silver nitrate per liter and a gelatine content of 15% are added varying quantities of penicillamine, namely 0, 0.25, 0.5, 1.0, 2.0 and 4.0 mg of penicillamine per mol of silver halide, and the emulsion is stirred for 10 minutes at 40° C. 20 ml of a 5% saponin solution are then added to the emulsion. 35 ml of a 2% formalin solution per mol of silver halide are added to the emulsion shortly before casting to harden it.

The protective layer contains 5% of a suitable protective layer gelatine, 40 ml of a 5% saponin solution and 40 ml of a 5% saccharose monolaurate solution per liter of protective layer solution.

When the emulsion is ready for casting, a length of film containing 9.5 g of $AgNO_3m^2$ and having a protective layer with a thickness of 1.8$\mu$ is cast on a polyester support which has an antihalation backing and dried. The total thickness of this film is 12$\mu$m. Sensitometer strips of the fresh film and of film which has been stored for 72 hours at 60° C. are then exposed in a high speed sensitometer for 1/1000 second and processed in the usual manner.

The developer has the following composition:

| | |
|---|---|
| KBr | 3.4 g |
| Hydroquinone | 8 g |
| 1-Phenylpyrazolidone | 0.3 g |
| $K_2S_2O_5$ | 18.5 g |
| KOH, 40% | 20 ml |
| $H_3BO_3$ | 2.5 g |
| $K_2CO_5$ | 15 g |
| Water: up to 1 l. | |

The development time at 26° C. is 2 minutes 30 seconds. The fog values, sensitivities, gradations and sensitivity increases after storage of the fresh sample and the corresponding values of samples which have been stored in the heating cupboard are summarised in Table 1.

The series of experiments shows that the fog value and increase in sensitivity after storage in the heating cupboard are reduced by the addition of only 0.25 mg of penicillamine per mol of silver halide. Optimum results are obtained with 2.0 mg of penicillamine per mol of silver halide, which produces an increase in sensitivity of 50%.

TABLE 1

| | mg of penicillamine per mol of silver halide | Fog | E | γ | Heating cupboard 3 days Fog | Δ 60° C. / log It at D=0.30 | γ |
|---|---|---|---|---|---|---|---|
| 1 | 0 | 0.05 | 100 | 1.56 | 0.11 | +0.32 | 1.42 |
| 2 | 0.25 | 0.05 | 130 | 1.53 | 0.10 | +0.20 | 1.44 |

TABLE 1-continued

| | mg of penicillamine per mol of silver halide | Fog | E | γ | Heating cupboard 3 days Fog | Δ 60° C. / log It at D=0.30 | γ |
|---|---|---|---|---|---|---|---|
| 3 | 0.5 | 0.05 | 130 | 1.53 | 0.09 | +0.17 | 1.41 |
| 4 | 1.0 | 0.05 | 140 | 1.53 | 0.09 | +0.15 | 1.44 |
| 5 | 2.0 | 0.05 | 150 | 1.55 | 0.09 | +0.13 | 1.45 |
| 6 | 4.0 | 0.05 | 150 | 1.56 | 0.10 | +0.12 | 1.44 |

E = relative sensitivity determined at density D = 0.3
doubling of E corresponds to doubling of the sensitivity
γ = gradation between densities 0.3 and 1.7.

I claim:

1. Photographic silver halide emulsions wherein at the most 9 mg per mol of silver halide of at least one compound corresponding to the general formula I are contained:

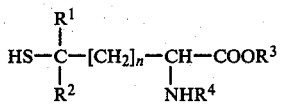

I in which $R^1$ represents hydrogen or an alkyl, aryl, aralkyl or acyl group;
$R^2$ represents an alkyl, aryl, aralkyl or acyl group;
$R^3$ represents hydrogen or a cation;
$R^4$ represents hydrogen or an alkyl group and
n represents 0 or a whole number, and/or
$R^1$ and $R^2$ together represent the atoms required to complete a ring,
and/or the corresponding disulphide.

2. Process for the preparation of a photographic silver halide emulsion by precipitation of the silver halide in the presence of a protective colloid, wherein at least one compound corresponding to the following formula I

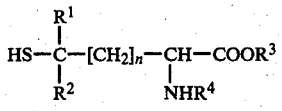

I in which $R^1$ represents hydrogen or an alkyl, aryl, aralkyl or acyl group;
$R^2$ represents an alkyl, aryl, aralkyl or acyl group;
$R^3$ represents hydrogen or a cation;
$R^4$ represents hydrogen or an alkyl group and
n represents 0 or a whole number and/or
$R^1$ and $R^2$ together represent the atoms required to complete a ring, is added to the emulsion in a quantity of at most 9 mg per mol of silver halide.

3. Photographic material consisting of a support layer and at least one light-sensitive silver halide emulsion layer and optionally other layers, wherein at the most 9 mg per mol of silver halide of at least one compound corresponding to the general formula are contained:

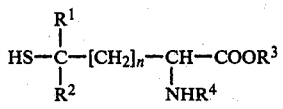

I in which $R^1$ represents hydrogen or an alkyl, aryl, aralkyl, or acyl group;
$R^2$ represents an alkyl, aryl, aralkyl or acyl group;
$R^3$ represents hydrogen or a cation;
$R^4$ represents hydrogen or an alkyl group and
n represents 0 or a whole number and/or
$R^1$ and $R^2$ together represent the atoms required to complete a ring
and/or the corresponding disulphide.

4. Photographic material according to claim 3, wherein the compound is contained in a silver halide emulsion layer in a quantity of at the most 9 mg/mol of silver halide.

5. Material according to claim 3, wherein
$R^1$ represents hydrogen or an alkyl group having 1 to 4 carbon atoms;
$R^2$ represents an alkyl group having 1 to 4 carbon atoms;
$R^3$ represents hydrogen or a cation;
$R^4$ represents hydrogen and
n represents 0, 1 or 2.

6. Material according to claim 3, wherein
$R^1$ represents methyl
$R^2$ represents methyl
$R^3$ represents hydrogen
$R^4$ represents hydrogen
n represents 0.

7. A photographic silver halide emulsion wherein at the most 9 mg per mol of silver halide of at least one compound corresponding to the general formula I are contained:

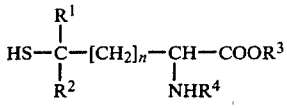

I in which
$R^1$ represents a methyl or ethyl group;
$R^2$ represents a methyl or ethyl group;
$R^3$ represents hydrogen or a cation;
$R^4$ represents hydrogen or an alkyl group and
n represents 0 or a whole number, and/or the corresponding disulphide.

8. A process for the preparation of a photographic silver halide emulsion by precipitation of the silver halide in the presence of a protective colloid, wherein at least one compound corresponding to the following formula I

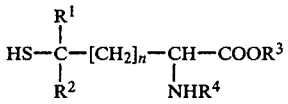

I in which
$R^1$ represents a methyl or ethyl group;
$R^2$ represents a methyl or ethyl group;
$R^3$ represents hydrogen or a cation;
$R^4$ represents hydrogen or an alkyl group and
n represents 0 or a whole number,
is added to the emulsion in a quantity of at most 9 mg per mol of silver halide.

* * * * *